United States Patent [19]

Wood

[11] 4,096,985

[45] Jun. 27, 1978

[54] ARTICLE CARRIER AND BLANK THEREFOR

[75] Inventor: Prentice J. Wood, Hapeville, Ga.

[73] Assignee: The Mead Corporation, Dayton, Ohio

[21] Appl. No.: 869,467

[22] Filed: Jan. 16, 1978

[51] Int. Cl.[2] ..... B65D 5/02; B65D 75/08; B65D 1/22

[52] U.S. Cl. ..... 229/40; 206/427

[58] Field of Search ..... 229/40; 206/155, 161, 206/427

[56] References Cited

U.S. PATENT DOCUMENTS

| | | | |
|---|---|---|---|
| 3,067,924 | 12/1962 | Baker et al. | 229/35 |
| 3,176,902 | 4/1965 | Champlin | 229/40 |
| 3,294,280 | 12/1966 | Graser | 206/155 |
| 3,356,283 | 12/1967 | Champlin | 229/40 |
| 3,428,235 | 2/1969 | Randazzo | 229/40 |
| 3,612,266 | 10/1971 | Graser | 206/161 |
| 3,899,076 | 8/1975 | Floriam | 206/427 |
| 3,963,121 | 6/1976 | Kipp | 229/40 |
| 3,963,170 | 6/1976 | Wood | 229/40 |
| 4,022,372 | 5/1977 | Graser | 229/40 |

*Primary Examiner*—Davis T. Moorhead

*Attorney, Agent, or Firm*—Walter M. Rodgers; Walter A. Rodgers

[57] ABSTRACT

An article carrier formed from a unitary blank and comprising a bottom wall, a pair of side walls foldably joined respectively to the side edges of the bottom wall, a pair of overlapping top panels foldably joined respectively to the upper edges of the side walls, a securing aperture formed in one of the top panels and having a diagonal securing edge, a securing tab foldably joined to the other top panel and disposed in the securing aperture with the fold line between the securing tab and the other top panel disposed in substantial coincidence with the securing edge, a pair of retaining flaps foldably joined respectively to the end edges of the bottom wall, a pair of tuck flaps foldably adjoined along adjacent edges and foldably joined along the edges thereof remote from the adjacent edges respectively to the adjacent side wall and the adjacent retaining flap, a locking aperture formed in one of the tuck flaps, and a locking tab struck from the other tuck flap and adapted to form an interlocked relationship with the locking aperture.

18 Claims, 7 Drawing Figures

ARTICLE CARRIER AND BLANK THEREFOR

In order to enhance environmental quality and to lower the consumption of energy, a reusable article carrier is required which is both economical and easy to use. By the utilization of such an article carrier, an effective means is provided by which nonreturnable multiple primary packages can be effectively transported and disposed of as refuse or returnable primary packages can be conveniently returned to the point of sale.

According to this invention an article carrier is provided and comprises a bottom wall, a pair of side walls foldably joined respectively to the side edges of the bottom wall, a pair of overlapping top panels foldably joined respectively to the upper edges of the side walls, a securing aperture formed in one of the top panels and having a securing edge, the securing edge being disposed in diagonal relation to the side edges of the top panels, a securing tab foldably joined to the other of said top panels and disposed in said securing aperture, and the fold line between the securing tab and the other top wall being disposed in substantial coincidence with the securing edge.

Figure 1:
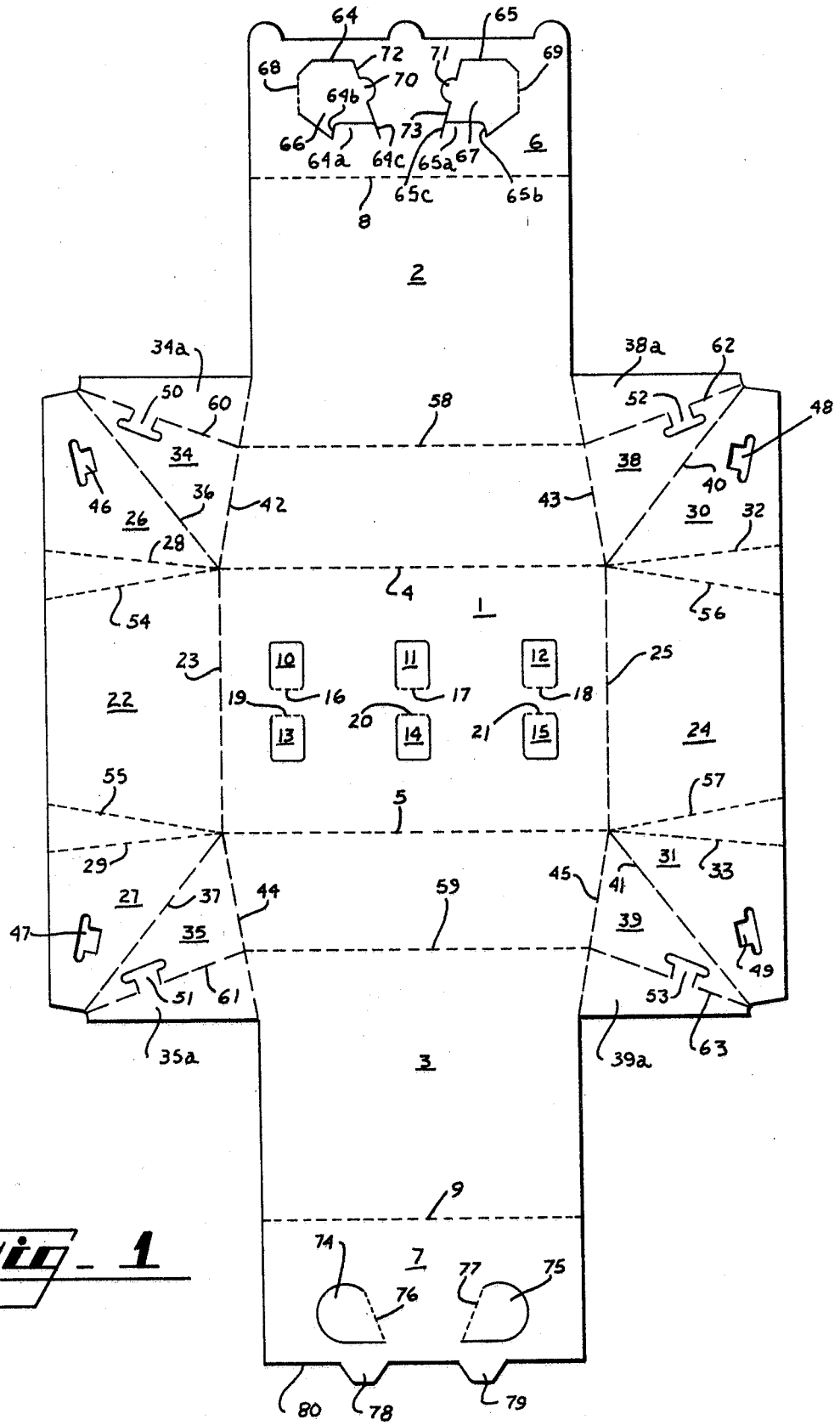
Figure 7:
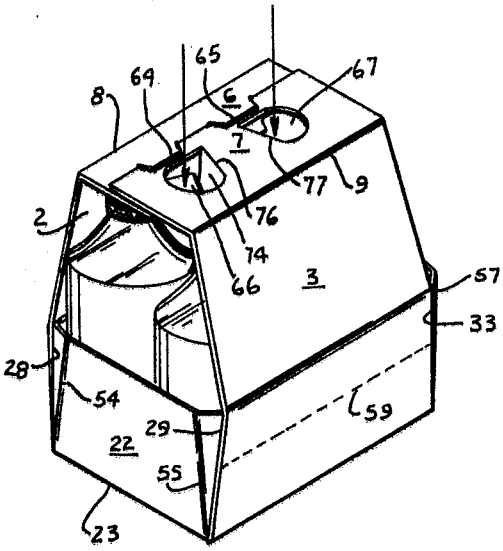

For a better understanding of the invention, reference may be had to the following description taken in conjunction with the accompanying drawing in which FIG. 1 is a plan view of a blank from which the completed carrier is formed and in which FIGS. 2, 3, 4, 5 and 6 depict intermediate stages through which the blank shown in FIG. 1 is manipulated in order to form the completed carrier as shown in FIG. 7.

In the drawings, the numeral 1 designates the bottom wall of the carrier to the side edges of which side walls 2 and 3 are foldably joined respectively along fold lines 4 and 5. Top panels 6 and 7 are foldably joined respectively to the upper edges of side walls 2 and 3 along fold lines 8 and 9. In order to prevent undesirable movement of the articles in the completed carrier, separating tabs 10, 11, 12, 13, 14 and 15 are struck from bottom wall 1 and are foldably joined thereto respectively along fold lines 16, 17, 18, 19, 20 and 21.

At one end of bottom wall 1, retaining flap 22 is foldably joined thereto along fold line 23 and, likewise, at the other end of bottom wall 1, retaining flap 24 is foldably joined thereto along fold line 25.

In order to complete the necessary end closure structure for the carrier, a series of tuck flaps are provided. More specifically, tuck flaps 26 and 27 are foldably joined to the opposite ends of retaining flap 22 respectively along fold lines 28 and 29. The structure at the opposite end of the carrier is similarly constructed and includes tuck flaps 30 and 31 which are foldably joined to the opposite ends of retaining flap 24 respectively along fold lines 32 and 33.

In addition tuck flaps 34 and 35 are provided with flap segments 34*a* and 35*a* respectively and are foldably joined respectively to tuck flaps 26 and 27 along fold lines 36 and 37. In similar fashion tuck flaps 38 and 39 include flap segments 38*a* and 39*a* respectively and are foldably joined respectively to tuck flaps 30 and 31 along fold lines 40 and 41. Also tuck flaps 34 and 38 are foldably joined to the ends of side wall 2 along fold lines 42 and 43 respectively. Likewise tuck flaps 35 and 39 are foldably joined respectively to the ends of side wall 3 along fold lines 44 and 45.

In order to insure that the tuck flaps are held securely in place, a series of locking mechanisms are provided.

More specifically, locking apertures 46, 47, 48, and 49 are formed respectively in tuck flaps 26, 27, 30, and 31. Also locking tabs 50, 51, 52 and 53 are struck from tuck flaps 34, 35, 38, and 39 respectively and constitute integral extensions of flap segments 34*a*, 35*a*, 38*a*, and 39*a*.

In order to allow the end closure structure of the carrier to easily conform to the natural curvature of the packaged articles, a series of score lines are provided. More specifically, score lines 54 and 55 are formed in retaining flap 22 and, similarly, score lines 56 and 57 are formed in retaining flap 24.

In order to facilitate formation of the carrier, score lines 58 and 59 are formed in side walls 2 and 3 respectively and score lines 60, 61, 62 and 63 are formed respectively in tuck flaps 34, 35, 38, and 39 and define the edges of flap segments 34*a*, 35*a*, 38*a* and 39*a*.

According to one aspect of this invention, carrier locking means is provided in top panels 6 and 7. More specifically securing apertures 64 and 65 are formed in top panel 6 and are defined by holding flaps 66 and 67 which are foldably joined to top panel 6 respectively along fold lines 68 and 69. Holding portions 64*a* and 65*a* are defined by edges 64*b* and 65*b* and by slits 64*c* and 65*c* as is apparent in FIG. 1. The holding flaps 66 and 67 are provided respectively with holding tabs 70 and 71. Also securing apertures 64 and 65 are provided respectively with securing edges 72 and 73. At the opposite end of the blank, securing tabs 74 and 75 are foldably joined to top panel 7 respectively along fold lines 76 and 77 and locking toes 78 and 79 are formed on the side edge 80 of top panel 7.

Figure 2:
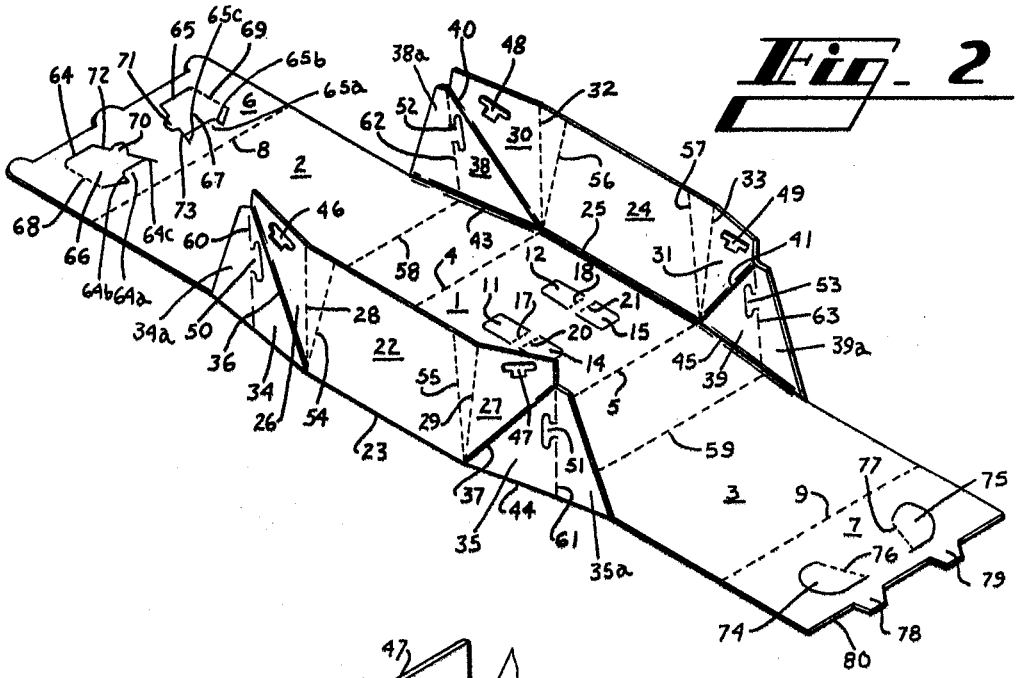

In order to form the completed carrier from the blank shown in FIG. 1, initially it is necessary to fold separating tabs 10–15 into vertical positions and then to position the articles to be packaged on the blank, the articles being omitted from FIGS. 1–4 for purposes of clarity. Then it is necessary to fold retaining flap 22 together with tuck flaps 26, 27, 34 and 35 upwardly along fold lines 23, 42 and 44. Simultaneously the end closure structure at the opposite side of the blank including retaining flap 24 and tuck flaps 30, 31, 38 and 39 is folded upwardly along fold lines 25, 43, and 45. The carrier then appears as shown in FIG. 2.

Then side wall 2 together with top panel 6 and side wall 3 together with top panel 7 are elevated and folded respectively along fold lines 4 and 5 to occupy positions substantially perpendicular to bottom wall 1. This causes tuck flaps 34 and 38 to swing into substantial face contacting relation with the inner surface of side wall 2. At the same time tuck flaps 35 and 39 swing into substantial face contacting relation with the inner surface of side wall 3.

Figure 3:
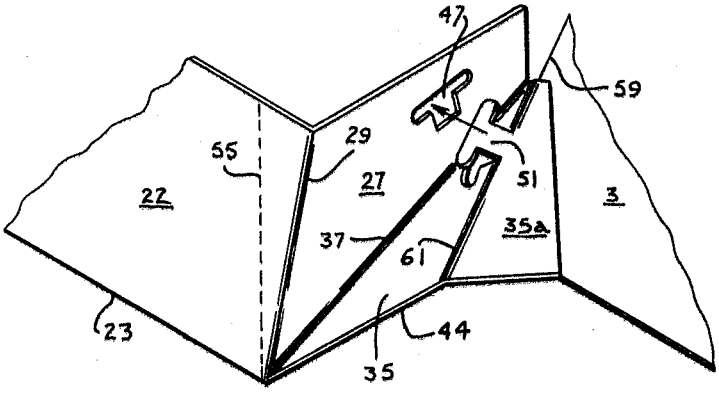

Following this operation, side wall 2 and tuck flaps 34 and 38 are folded outwardly with respect to the carrier along fold lines 58, 60 and 62 respectively. During this folding operation, fold lines 60 and 62 are in virtual coincidence with fold line 58 and flap segments 34*a* and 38*a* are in face contacting relation with the part of side wall 2 which is above fold line 58. Also side wall 3 and tuck flaps 35 and 39 are folded outwardly with respect to the carrier along fold lines 59, 61 and 63 respectively. This operation is performed with fold lines 61 and 63 in substantial coincidence with fold line 59 and with flap segments 35*a* and 39*a* in face contacting relation with the part of side wall 3 which is above fold line 59. This causes locking tabs 50, 51, 52 and 53 to remain in the planes of flap segments 34*a*, 35*a*, 38*a* and 39*a* respectively and to swing out of the plane of their associated tuck flaps 34, 35, 38 and 39 respectively as best shown in FIG. 3.

Figure 4:
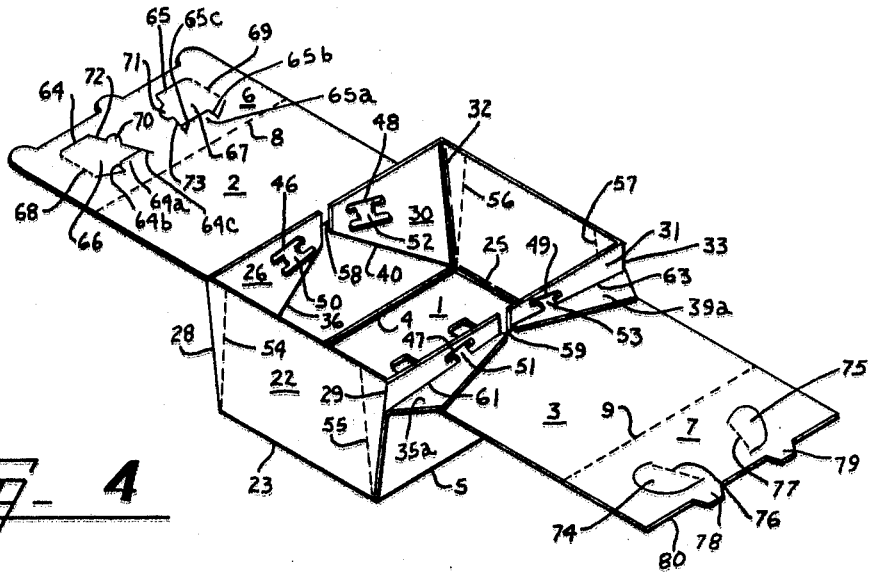
Figure 5:
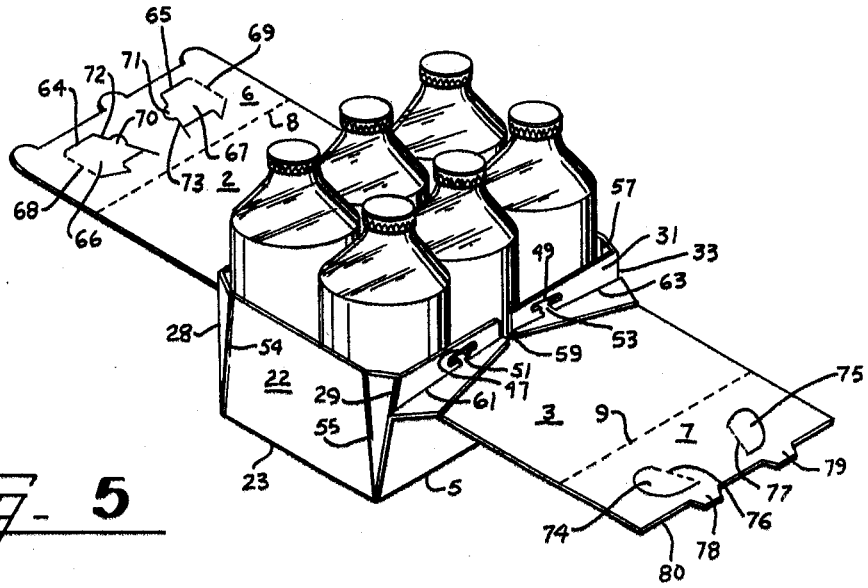
Figure 6:
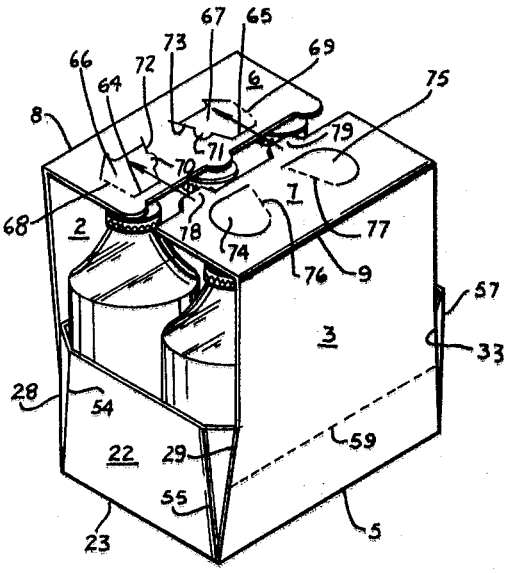

Then side walls 2 and 3 and associated structure are swung inwardly with respect to the carrier. This forces locking tabs 50, 51, 52 and 53 into interlocked relationship respectively with locking apertures 46, 47, 48 and 49. The carrier then appears as shown in FIG. 4.

Following this, side walls 2 and 3 are elevated along fold lines 58 and 59 respectively. In addition top panels 6 and 7 are folded over along fold lines 8 and 9 respectively to positions substantially perpendicular to side walls 2 and 3 and top panel 7 is moved into overlapping face contacting relation with top panel 6 while locking toes 78 and 79 are inserted into securing apertures 64 and 65 respectively. Side edge 80 of top panel 7 moves into slits **64*c* and 65*c* and holding portions 64*a* and 65*a* overlie top panel 7 and are adjacent the apertures defined by securing tabs 74 and 75. Finally securing tabs 74 and 75 are driven through securing apertures 64 and 65 respectively. The carrier then appears as shown in FIG. 7** which represents the completed carrier.

Therefore it can be seen that, in the completed carrier, securing edges 72 and 73 of securing apertures 64 and 65 respectively are diagonally disposed with respect to the side edges of top panels 6 and 7. In addition, fold lines 76 and 77 of securing tabs 74 and 75 are disposed in substantial coincidence with securing edges 72 and 73 respectively. This structural feature causes securing edges 72 and 73 to resist any premature unlocking of top panels 6 and 7 and securely hold locking toes 78 and 79 in locked condition. In addition securing tabs 74 and 75 are held in the locked position by means of the holding tabs 70 and 71 of holding flaps 66 and 67 respectively as shown in FIG. 7. Thus securing tabs 74 and 75 are held snugly against securing edges 72 and 73 respectively and any tendency for securing tabs 74 and 75 to swing back into the plane of top panel 7 is prevented.

Therefore since no adhesive is used in the construction of this carrier, it is conveniently reusable. Also when it is desired to open the carrier, securing tabs 74 and 75 simply are manually withdrawn from securing apertures 64 and 65 respectively and top panels 6 and 7 are swung apart sidewise and then upwardly to slide locking toes 78 and 79 out of their apertures and to allow for convenient access to the packaged articles. After use, the empty articles are simply replaced in the original carrier for disposal or storage as required.

When the top panels of the carrier are unlocked, the overall integrity of the carrier is maintained by the tuck flap structure at each end of the carrier and the associated locking apertures and locking tabs which securely maintain the carrier in set up condition. Therefore by this invention an article carrier is provided which is economical to produce, convenient to use, and available for reuse as necessary in connection with modern returnable primary packages.

The embodiments of the invention in which an exclusive property or privilege is claimed are defined as follows:

1. An article carrier comprising a bottom wall, a pair of side walls foldably joined respectively to the side edges of said bottom wall, a pair of overlapping top panels foldably joined respectively to the upper edges of said side walls, a securing aperture formed in one of said top panels and having a securing edge, said securing edge being disposed in diagonal relation to the side edges of said top panels, a securing tab foldably joined to the other of said top panels and disposed in said securing aperture, and the fold line between said securing tab and said other top panel being disposed in substantial coincidence with said securing edge.

2. An article carrier according to claim 1 wherein a holding flap is foldably joined to said one top panel along the edge of said securing aperture remote from said securing edge and wherein said holding flap is angularly disposed with respect to said securing tab.

3. An article carrier according to claim 2 wherein a holding tab is formed on the outer edge of said holding flap and wherein the outer portion of said holding tab is disposed in abutting relationship with said securing tab.

4. An article carrier according to claim 1 wherein a locking toe is formed on a side edge of said other top panel and is disposed underneath an edge of said securing aperture.

5. An article carrier according to claim 4 wherein a holding portion forms an inwardly extending projection of said securing aperture adjacent said locking toe.

6. An article carrier according to claim 1 wherein a pair of retaining flaps are foldably joined respectively to the end edges of said bottom wall.

7. An article carrier according to claim 6 wherein a pair of tuck flaps are foldably adjoined along adjacent edges and wherein said tuck flaps are foldably joined along the edges remote from said adjacent edges respectively to the adjacent side wall and the adjacent retaining flap.

8. An article carrier according to claim 7 and characterized by a locking aperture formed in one of said tuck flaps and by a locking tab struck from the other of said tuck flaps and adapted to form an interlocked relationship with said locking aperture.

9. An article carrier comprising a bottom wall, a pair of side walls foldably joined respectively to the side edges of said bottom wall, a pair of retaining flaps foldably joined respectively to the end edges of said bottom wall, a pair of tuck flaps foldably adjoined along adjacent edges, said tuck flaps being foldably joined along the edges remote from said adjacent edges respectively to the adjacent side wall and the adjacent retaining flap, a locking aperture formed in one of said tuck flaps, and a locking tab struck from the other of said tuck flaps and adapted to form an interlocked relationship with said locking aperture.

10. An article carrier according to claim 9 wherein a score line is formed in said adjacent side wall and in said other tuck flap to facilitate the positioning of said locking tab into said locking aperture.

11. An article carrier according to claim 10 wherein said score line in said other tuck flap defines a flap segment from which said locking tab projects.

12. An article carrier according to claim 10 wherein said score lines are in substantial coincidence during the performance of a locking operation.

13. An article carrier blank comprising a bottom wall, a pair of side walls foldably joined respectively to the side edges of said bottom wall, a pair of top panels foldably joined respectively to the edges of said side walls remote from said bottom wall, a securing aperture formed in one of said top panels and having a securing edge, said securing edge being disposed in diagonal relation to the side edges of said top panels, a securing tab foldably joined to the other of said top panels, and the fold line between said securing tab and said other top wall being substantially parallel to said securing edge.

14. An article carrier blank according to claim 13 wherein a holding flap is foldably joined to said one top panel along the edge of said securing aperture remote from said securing edge.

15. An article carrier blank according to claim 13 wherein a locking toe is formed on a side edge of said other top panel.

16. An article carrier blank according to claim 13 wherein a holding portion forms an inwardly extending projection of said securing aperture.

17. An article carrier blank according to claim 13 wherein a pair of retaining flaps are foldably joined respectively to the end edges of said bottom wall, wherein a first tuck flap is foldably joined to an end edge of one of said retaining flaps, and wherein a second tuck flap is foldably joined respectively to said first tuck flap remote from said retaining flap and to the adjacent side wall.

18. An article carrier blank according to claim 17 wherein a locking aperture is formed in one of said tuck flaps and wherein a locking tab is struck from the other of said tuck flaps.

* * * * *